United States Patent [19]

Hoffman

[11] Patent Number: 4,466,528

[45] Date of Patent: Aug. 21, 1984

[54] APPARATUS FOR PREVENTING CIRCUIT BURN-OUT IN MULTI-PRICE MERCHANDISERS

[75] Inventor: David Hoffman, Hillsdale, N.J.

[73] Assignee: Rowe International, Inc., Whippany, N.J.

[21] Appl. No.: 292,692

[22] Filed: Aug. 13, 1981

[51] Int. Cl.[3] ..... G07F 11/00

[52] U.S. Cl. ..... 194/1 N; 194/10; 363/53

[58] Field of Search ..... 194/1 R, 1 M, 1 N, 2, 194/10, DIG. 3; 221/124, 125, 129; 361/67, 68; 363/50, 52, 53

[56] References Cited

U.S. PATENT DOCUMENTS

| | | | |
|---|---|---|---|
| 3,023,353 | 2/1962 | Currey | 363/53 |
| 3,045,168 | 7/1962 | Fellendorf | 363/53 |
| 4,034,839 | 7/1977 | Lee | 194/10 |
| 4,094,398 | 6/1978 | Camp et al. | 194/10 |
| 4,267,915 | 5/1981 | McLaughlin et al. | 194/2 X |
| 4,284,184 | 8/1981 | Hoffman | 194/1 N |

*Primary Examiner*—F. J. Bartuska

*Attorney, Agent, or Firm*—Shenier & O'Connor

[57] ABSTRACT

Apparatus for preventing circuit burn-out in motor driven merchandisers, in one form of which a plurality of redundant diodes connects a price matrix to the open contacts of the selection switches. In another form, the price matrix is connected to the first normally open contacts of double pole, double throw selection switches, the second normally open contacts connected to the delivery drive means.

3 Claims, 2 Drawing Figures

APPARATUS FOR PREVENTING CIRCUIT BURN-OUT IN MULTI-PRICE MERCHANDISERS

FIELD OF THE INVENTION

My invention is in the field of multi-price motor driven merchandisers and, more particularly, in the field of apparatus for preventing circuit burn-out in multi-price merchandisers.

BACKGROUND OF THE INVENTION

There are known in the prior art multi-price motor driven merchandisers which are adapted to vend a wide variety of articles at a wide range of prices. One machine of this type is shown in U.S. Pat. application Ser. No. 146,313, filed May 5, 1980 now U.S. Pat. No. 4,317,604. These machines incorporate price setting matrixes associated with multi-price coin mechanisms.

While these matrixes are effective for setting different purchase prices for the various articles, they embody a major disadvantage in that they contain a multiplicity of diodes, the failure of one of which may result in the failure of many others owing to the resulting excessive current flow through the components of the merchandiser. Often, a simple diode failure can cause massive destruction to the price matrix.

OBJECTS OF THE INVENTION

One object of my invention is to provide apparatus for preventing circuit burn-out in multi-price merchandisers which overcomes the defects inherent in price-setting matrixes.

Another object of my invention is to provide apparatus which prevents massive circuit burn-out as a result of diode failure.

Still another object of my invention is to provide apparatus which prevents excessive current flow through the components of the machine in the event of diode failure.

BRIEF DESCRIPTION OF THE DRAWINGS

In the accompanying drawings to which reference is made in the instant specification and in which like reference characters are used to indicate like parts in the various views.

DESCRIPTION OF THE PREFERRED EMBODIMENT

Figure 1:
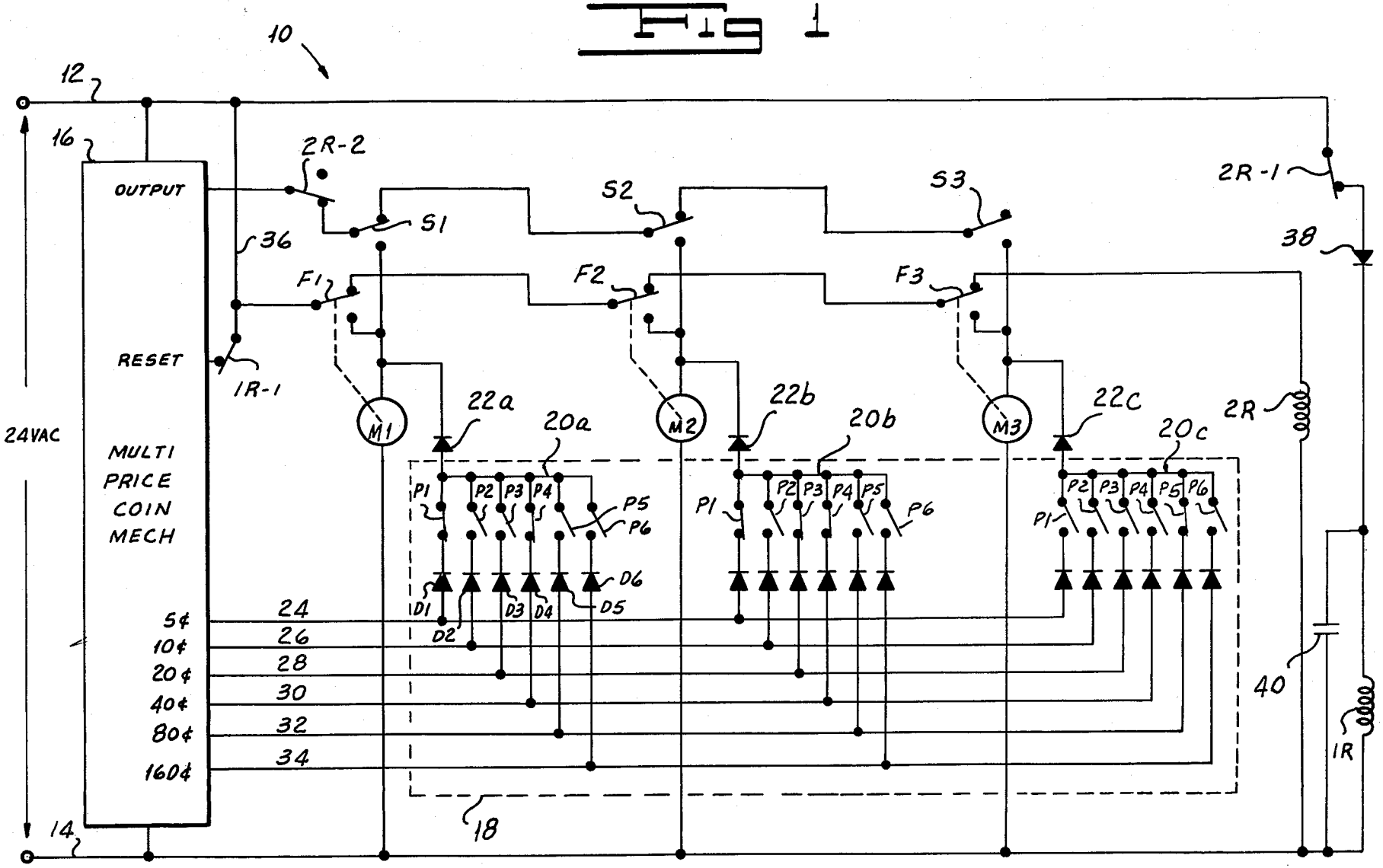
FIG. 1 is a schematic view of a control circuit for a Helix-type merchandiser incorporating one form of my apparatus for preventing circuit burn-out.

Referring now to FIG. 1 of the drawings, a typical control circuit for a merchandiser of the type which is adapted to sell a variety of articles at widely varying prices, indicated generally by the reference character 10, includes a source of voltage, such for example as a 24-volt 60 Hz source having output lines 12 and 14. A coin mechanism 16 connected between terminals 12 and 14 has an "output" pin, connected by normally closed switch 2R-2 to a plurality of selection switches S1 to S3, shown in their normal open positions. For purposes of simplicity, I have illustrated only three selection switches, the normally open contacts of which I connect to respective motors M1 to M3 and to respective price selection switch arrays **20*a* to 20*c* through respective redundant diodes 22*a* to 22*c*, as will be more fully described hereinbelow. Coin mechanism 16** may be of the type shown in Lee U.S. Pat. No. 4,034,839.

Each of the price selection arrays includes a plurality of price selection switches P1 to P6 connected in series with diodes D1 to D6 between respective price lines 24, 26, 28, 30, 32 and 34 and the common line leading to the normally open contact of the corresponding selection switch, one of switches S1 to S3. The switches P1 through P5 of each of the arrays **20*a* to 20*c* are closed by the service person to set the corresponding selection to sell at a particular price. For example, only switches P1 and P4 of array 20*a* are closed so that the article corresponding to selection switch S1 sells for a price of 45 cents. Switches P1, P3 and P4 of array 20*b* are closed so that the selection corresponding to switch S2 sells for a price of 65 cents. Only switch P5 of array 20*c* is closed so that the selection corresponding to switch S3** sells for a price of 80 cents.

Line 36 supplies power to the "reset" pin of the coin mechanism 16 through normally closed switch 1R-1, to a plurality of full-cycle switches F1 to F3 corresponding to respective motors M1 to M3, and to the "vend" relay 2R. Switch 2R-1 supplies power through diode 38 to the "reset" relay 1R connected in parallel to shunt capacitor 40.

During normal operation of the merchandiser, the coin mechanism 16 generates negative or low level interrogating pulses on its output pin which are placed on the selection switches S1 to S3 through normally closed switch 2R-2. Upon the closure of a selection switch, the interrogating pulses are applied to an array **20*a* to 20*c*, and to a motor M1 to M3. The pulses, insufficient to energize the motor, are routed through the closed price selection switches P1 to P6, to the price lines 24 to 34 of the coin mechanism 16, informing the coin mechanism of the purchase price of the article corresponding to the closed selection switch. If a sum of money at least equal to the purchase price of the selected article has been credited in the coin mechanism, the mechanism changes the negative pulses to a 24-volt signal which energizes the corresponding motor through the actuated selection switch. The motor immediately closes its corresponding full cycle switch F1 to F3 to receive power independent of the coin mechanism from line 12 through line 36. The closure of the full cycle switch deenergizes the vend relay 2R to open switches 2R-1 and 2R-2, cutting off power to the selector switches to prevent multiple vends and deenergizing relay 1R to open switch 1R-1**, resetting the coin mechanism.

Diodes D1 to D6, for each array, permit the negative interrogating pulses to continue to the price lines 24 to 34 and serve to rectify the 24-volt signal used to energize the motors to enable a vend, preventing the positive portion of the alternating current from passing to any of the price lines. When a diode fails, it usually presents a zero impedance path or a short circuit, allowing unrectified current flow. In an arrangement of the prior art which does not include diodes 22, in the event of diode failure, such as diode D1 of array **20*a* for example, unrectified 24-volt alternating current flows first from the output pin and then directly from line 12 through the full cycle switch F1 to price line 24. The positive portion of the signal continues through the five cent diode D1 of any other array 20*a* to 20*c*** in which the five cent selection switch P1 is closed, such as array 20*b* for example, and to the corresponding motor M2 to line 14. This results in such high current flow through the motor and diode as to cause the diode to burn out, together possibly with its circuit wiring. Thus, in the arrangement of the prior art failure of one diode is likely to result in multiple diode failure and possible wiring burn-out where circuit boards are employed.

Redundant diodes 22*a*, 22*b*, and 22*c* prevent unrectified current flow to any of the price lines 24 to 34, due to a failure of any of the diodes D1 to D6 of the arrays 20*a* to 20*c*, eliminating circuit burn-out unless the failure of one of the diodes D1 to D6 is accompanied by the failure of the corresponding redundant diode as well. It will readily be appreciated that the probability of the latter occurrence is very low.

Figure 2:
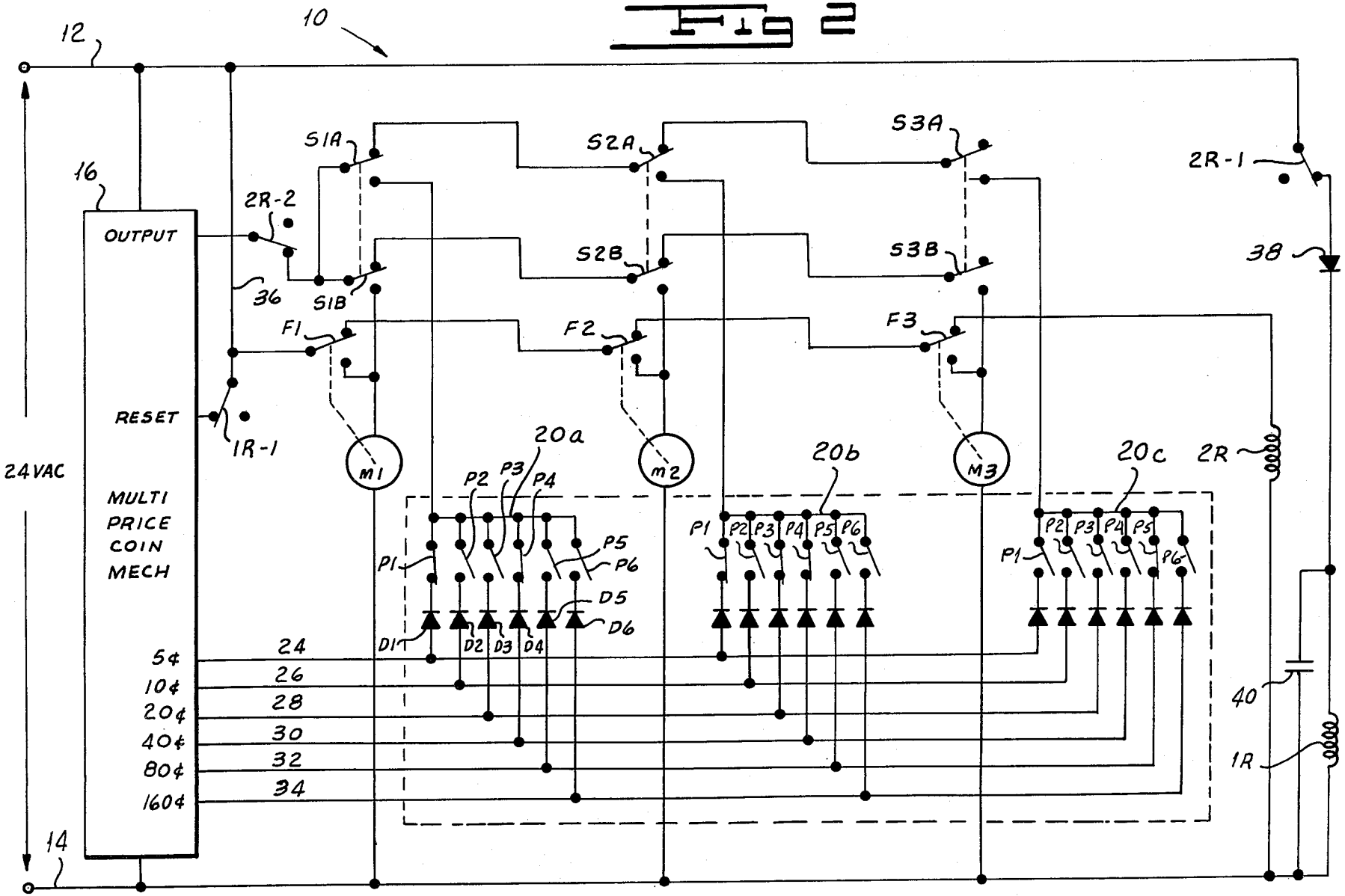
FIG. 2 is a schematic view of a control circuit for a Helix-type merchandiser incorporating another embodiment of my apparatus for preventing circuit burn-out.

In the second embodiment of my invention illustrated in FIG. 2, the diode motor current path is eliminated, and double pole, double throw selection switches replace the single pole double throw switches used in the embodiment shown in FIG. 1. The output pin of the coin mechanism 16 is connected by switch 2R-2 to both poles A and B of selection switch S1. Upon the closure of a selection switch, the interrogating pulses generated by the coin mechanism are applied to the corresponding array 20 through the "A" pole of the actuated selection switch. If sufficient money has been deposited in the coin mechanism, the corresponding motor is energized by the 24-volt signal through the "B" pole of the actuated selection switch. In the unactuated positions of the switches S1 to S3, both the "A" poles and the "B" poles of the switches are connected in series.

If one of the diodes D1 to D6 of any array should fail, unrectified A.C. current can still flow from the output pin to the affected price line; however, as there is no longer a path through the diodes to a motor, no excessive currents which may destroy components will flow.

It will be seen that I have accomplished the objects of my invention. I have provided apparatus for preventing circuit burn-out in multi-price merchandisers due to the inherent defects in external price matrix. My apparatus prevents excessive current flow through the components of the machine and massive circuit burn-out due to diode failure.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a merchandising machine control circuit including a money register having a plurality of price lines adapted to be activated in response to the deposit of money in said register and producing a relatively low level interrogating signal and a relatively high level driving signal in response to the application of said selecting signal to activated ones of said price lines, a plurality of groups of price setting switches, respective groups of isolating devices connecting said price setting switches to said price lines, said price setting switches adapted to be closed to set each group to a particular price, a plurality of double pole double throw selection switches associated with said groups of price setting switches, each of said switches including a first pole normally in engagement with a first normally closed contact and adapted to engage a first normally open contact upon actuation of the switch and a second pole normally in engagement with a second normally closed contact and adapted to engage a second normally open contact upon actuation of the switch, said switches being arranged in series with the first normally closed contact of each preceding switch being connected to the first pole of the succeeding switch and with the second normally closed contact of each preceding switch being connected to the second pole of the succeeding switch, means connecting the respective second normally open contacts of said switches to said groups of price setting switches and means for applying said interrogating signal and said driving signal to said first and second poles.

2. In a merchandising machine having a plurality of article delivery units and respective energizable devices for enabling the delivery of merchandise from the units in response to the application of a driving signal to the corresponding device, a control circuit including in combination, a money responsive mechanism having a plurality of price lines adapted to be selectively activated in response to the deposit in said mechanism of respective sums of money, a source of interrogating signal and means responsive to the application of said interrogating signal to certain of the activated price lines for producing a driving signal, a plurality of price setting switch groups corresponding to the number of said delivery units, respective diodes connecting first terminals of the price setting switches of each group to said price lines, the price setting switches of each group adapted to be actuated to set the price of an article delivered by the associated unit, a plurality of double pole double throw selection switches associated with said units, each of said switches including a first pole normally in engagement with a first normally closed contact and adapted to engage a first normally open contact upon actuation of the switch and a second pole normally in engagement with a second normally closed contact and adapted to engage a second normally open contact upon actuation of the switch, said switches being arranged in series with the first normally closed contact of each preceding switch being connected to the first pole of the succeeding switch and with the second normally closed contact of each preceding switch being connected to the second pole of the succeeding switch, means connecting the respective first normally open contacts of said switches to said energizable devices, means connecting the respective second normally open contacts of said switches to said groups of price setting switches and means for applying said interrogating signal and said driving signal to said first and second poles.

3. In a control circuit for a merchandise machine having a plurality of dispensing units each comprising an energizable drive member, apparatus including a money register having a plurality of price lines adapted to be activated in response to the deposit of money in the register and an output terminal at which the register produces a relatively low level interrogating signal for application to said price lines and at which the register produces a relatively high level driving signal in response to the application of said interrogating signal to activated ones of said price lines and means connected to said output terminal for applying said interrogating signal to said price lines, said last-named means including respective groups of pricesetting switches, said groups corresponding in number to the number of said units, respective diodes connecting the pricesetting switches to said price lines, and respective doublepole double-throw switches corresponding in number to the number of said units, the poles of said switches being connected to said terminal, a normally-open contact of one pole of a switch being connected to a group of price-setting switches associated with the corresponding unit, a normallyopen contact of the other pole of the switch being connected to the energizable drive member of the corresponding unit.

* * * * *